United States Patent [19]

Kohl

[11] 4,449,382

[45] May 22, 1984

[54] WARP KNITTING MACHINE EQUIPPED WITH LATCH-TYPE NEEDLES

[75] Inventor: Karl Kohl, Obertshausen, Fed. Rep. of Germany

[73] Assignees: Morton Jablin, Tenafly; Johann Winter, Paramus, both of N.J. ; part interest to each

[21] Appl. No.: 349,626

[22] Filed: Feb. 17, 1982

[30] Foreign Application Priority Data

Aug. 20, 1981 [DE] Fed. Rep. of Germany ..... 3132958

[51] Int. Cl.[3] ..... D04B 23/00

[52] U.S. Cl. ..... 66/203; 66/208

[58] Field of Search ..... 66/203, 208

[56] References Cited

FOREIGN PATENT DOCUMENTS 1585205 10/1970 Fed. Rep. of Germany .

*Primary Examiner*—Ronald Feldbaum

*Attorney, Agent, or Firm*—Stephen E. Feldman

[57] ABSTRACT

A warp knitting machine typically equipped with latch-type needles, trace comb, and numerous guide bars for underlapping purposes. The keep-off rails for the pattern threads, running from the hook needles or guides to the latch-type needles, are mounted behind several or all latch-type needles, outside the operating range of the needle latch, their motion being synchronized with the motion of the needles. Typically, the lamellar keep-off rails, placed behind the latch-type needles in the direction of the oscillating movement, have an opening which is directed towards the needles. The opening in the rails has the shape of an orbit section which is slightly greater than the orbit section described by the latch of the needle. In a preferred embodiment, the lamellar keep-off rails are crimped in the direction of the shifting or shogging motion in the operating range of the needle latch.

12 Claims, 4 Drawing Figures

WARP KNITTING MACHINE EQUIPPED WITH LATCH-TYPE NEEDLES

BACKGROUND OF THE INVENTION

1. Field of the Invention

A warp knitting machine equipped with latch-type needles.

2. Description of the Prior Art

There are warp knitting machines equipped with latch-type needles, trace or stitch comb, and numerous guide bars for underlapping purposes which are only able to start the shifting or shogging motion of the underlapping bars after the needles have moved to a "closed" position in the course of a downward movement; i.e. the shifting motion starts only after the underlapping bars have moved forward. Consequently the number of tours of the machine can maximally amount to 300 to 350 with up to 30 and 40 guide bars, because there is only an angle of approx. 140° to 160° of the knitting cycle available for the guide bar in the rear.

SUMMARY OF THE INVENTION

1. Purposes of the Invention

It is an object of the present invention to provide an improved warp knitting machine.

Another object is to provide an improved warp knitting machine equipped with latch-type needles.

A further object is to provide such a machine in which keep-off rails for the pattern threads, running from the hook needles or guides to the latch-type needles, are mounted behind several or all of the latch-type needles, outside of the operating range of the needle latch, their motion being synchronized with the motion of the needles.

An additional object is to provide, in the lamellar keep-off rails placed behind the latch-type needles in the direction of the oscillating movement, an opening which is directed towards the needles, the opening in the rails having the shape of an orbit section which is slightly greater than the orbit section described by the latch of the needle.

Still another object is to provide lamellar keep-off rails which are crimped in the direction of the shifting or shogging motion in the operating range of the needle latch.

It is an important purpose of this invention to increase considerably the number of tours of a warp knitting machine equipped with latch-type needles.

These and other objects and advantages of the present invention will become evident from the description which follows.

2. Brief Description of the Invention

In accordance with the present invention, a warp knitting machine is typically equipped with latch-type needles, trace comb, and numerous guide bars for underlapping purposes. The keep-off rails for the pattern threads, running from the hook needles or guides to the latch-type needles, are mounted behind several or all latch-type needles, outside the operating range of the needle latch, their motion being synchronized with the motion of the needles. Typically, the lamellar keep-off rails, placed behind the latch-type needles in the direction of the oscillating movement, have an opening which is directed towards the needles. The opening in the rails has the shape of an orbit section which is slightly greater than the orbit section described by the latch of the needle. In a preferred embodiment, the lamellar keep-off rails are crimped in the direction of the shifting or shogging motion in the operating range of the needle latch.

In the present invention, for the purpose of increasing considerably the number of tours of the warp knitting machine equipped with latch-type needles, it is provided according to this invention that the keep-off rails, for the pattern threads running from the hole needles or guides to the latch-type needles, are placed behind several or all latch-type needles, outside the operating range of the needle latch. The motion of such keep-off rails is synchronous with the needle motion. By means of these new keep-off rails, the pattern threads running from the hole needles or guides to the latch-type needles are prevented from getting into the pull-in range of the latch-type needles, when the underlapping bars are still in a position behind the open latch-type needles. Consequently, the shifting or shogging motion of the underlapping bars can be extended to a considerably greater angle, i.e. to an angle of 260° to 280° of the knitting cycle. Accordingly, this leads to an increase of the speed of the machine. Practical experience has shown that the described new machines which are equpped in accordance with this invention are able to reach more than 400 tours. In addition to this, the greater angle of the shifting or shogging motion of the underlapping bars allows to bevel the chain links in a less oblique way, thus leading to a smoother running of the machine.

Since, as already mentioned before, the keep-off rails are mounted immediately behind the needles or are fastened to the needle leads or latch needle units and placed outside the orbit section described by the needle latch, the lamellar keep-off rails, placed behind the latch-type needles in the direction of the oscillating movement, can either have an opening in the shape of an orbit section which is slightly greater than the orbit section described by the needle latch, or they can be crimped in the operating range of the latch in the direction of the shifting or shogging motion.

Furthermore, it is advisable to provide a spacing between the keep-off rail which extends to the needle head and the needle hook, in order to secure an unhindered overlapping motion of the guide bars. The spacing between keep-off rail and needle head should be greater than the spacing between keep-off rail and needle hook point.

It is a special feature of this invention that the individual trace or stitch comb lamellas are equipped with latch stops. These latch stops may be lamellar, too, and, in order to be a secure stop for the bounding-up latch, their open ends may be resilient in the direction of the shifting or shogging motion, and be shaped in a way allowing them to spring around an axis which is parallel to the needle axis. This guarantees an unhindered extension of the trace or stitch comb. The latch stops exceeding the top edge of the trace or stitch comb lamellas can be connected to these lamellas in such a way that they form one piece.

Provided that the keep-off rails are crimped in the operating range of the needle latch, in the direction of the shifting or shogging motion, a continuous latch stop may be used, consisting of a wire leading from one end of the machine to the other, and borne by the lamellas of the trace or stitch comb.

In summary, the present invention contemplates a warp knitting machine equipped with latch-type needles, trace comb, and numerous guide bars for underlapping purposes. The machine is basically characterized by the provision of keep-off rails for the pattern threads, running from the hook needles or guides to the latch-type needles. The rails are mounted behind several or all of the latch-type needles, outside the operating range of the needle latch, their motion being synchronized with the motion of the needles. It is preferred that the lamellar keep-off rails, placed behind the latch-type needles in the direction of the oscillating movement, should have an opening which is directed towards the needles. This opening in the rails generally has the shape of an orbit section which is slightly greater than the orbit section described by the latch of the needle. In a preferred embodiment, the lamellar keep-off rails placed behind the latch-type needles in the direction of the oscillating motion are crimped in the direction of the shifting or shogging motion in the operating range of the needle latch.

Various specific preferred aspects, features, modes, and preferred embodiments within the context of the general invention just described may also be mentioned. The keep-off rails are preferably fastened to the needle leads or latch needle unit. The keep-off rails mounted behind one group of the latch-type needles, and extending to the head of the latch-type needles, are preferably placed in a certain distance from the operating range of the needle hook. In this preferred embodiment of the invention, the spacing between the keep-off rail and needle head is typically greater than the spacing between the keep-off rail and the needle hook point. Generally, there are latch stops on each individual lamella of the trace or stitch comb. Typically in this case, the latch stops are resilient at their open ends, in the direction of the shifting motion, and in this configuration, typically the latch stops are shaped, at least at their open ends, in a way enabling them to spring around an axis which is parallel to the needle axis. In this embodiment, typically the latch stops exceeding the top edge of the trace or stitch comb lamellas are attached to these lamellas, or form one piece together with the latter. Finally, in many instances the trace or stitch comb lamellas will bear the latch stops.

The invention accordingly consists in the features of construction, combination of elements, and arrangement of parts which will be exemplified in the machine device hereinafter described, and of which the scope of application is as elucidated supra and as will be indicated in the appended claims.

BRIEF DESCRIPTION OF THE DRAWINGS

In the accompanying drawings in which examples of operation of the invention are illustrated.

DETAILED DESCRIPTION OF THE PREFERRED EMBODIMENTS

Figure 1:
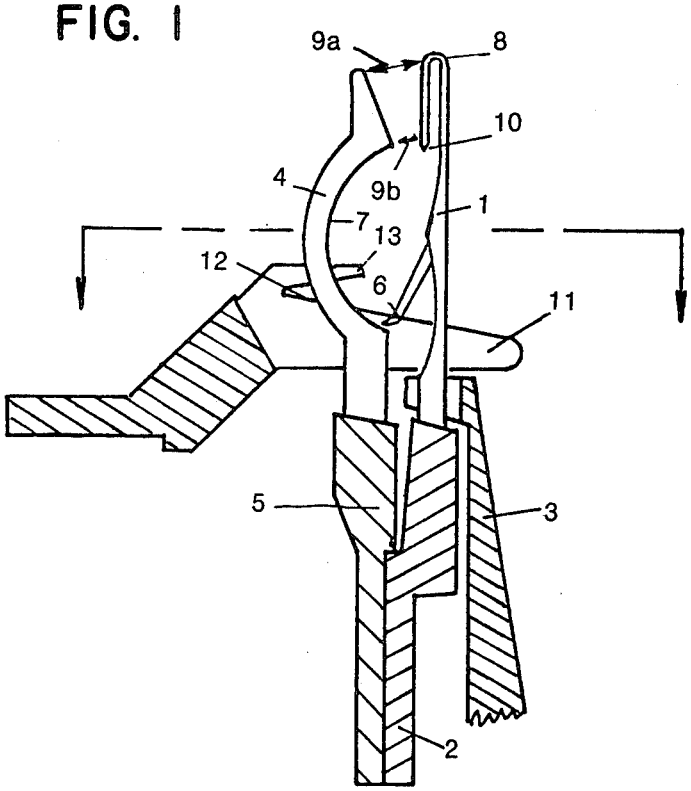
FIG. 1 is an example of operation for keep-off rail provided with opening for latch motion.
Figure 2:
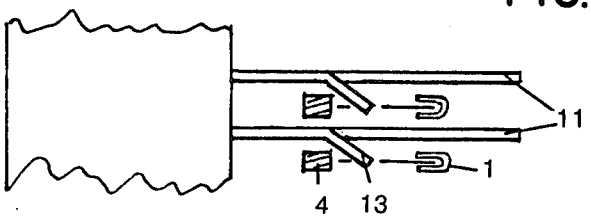
FIG. 2 is a partial side view of FIG. 1.

The latch-type needles (1) shown in FIG. 1 are fastened in the needle leads or latch needle unit (2). They operate in the comb of trick plate (3). The keep-off rails (4) placed behind the needles in the direction of the oscillating motion are mounted in leads unit (5), too, which are connected with the needles in such a way that needles and keep-off rails move synchronously. In the operating range of the needle latch (6), the keep-off rail is provided with an according opening (7). The keep-off rail extends to the needle head (8). The spacing between keep-off rail and needle head shall quarantee an unhindered overlapping motion of the guide bars. It is advisable to choose a spacing between keep-off rail and needle head (**9*a*), which is slightly greater than the spacing between keep-off rail and needle hook point (10) (9*b*). At their top edge (12) the trace or stitch comb lamellas are provided with latch stops (13). At their open ends these latch stops are resilient in the direction of the shifting or shogging motion, which enables them to reach the operating range of the latches. In order to hinder the latch stops (13) from causing damage to the keep-off rails (4) when the trace or stitch comb lamellas (11**) are moving out of the needle gutter (spaces between the latch needle), their open ends are resilient.

Figure 3:
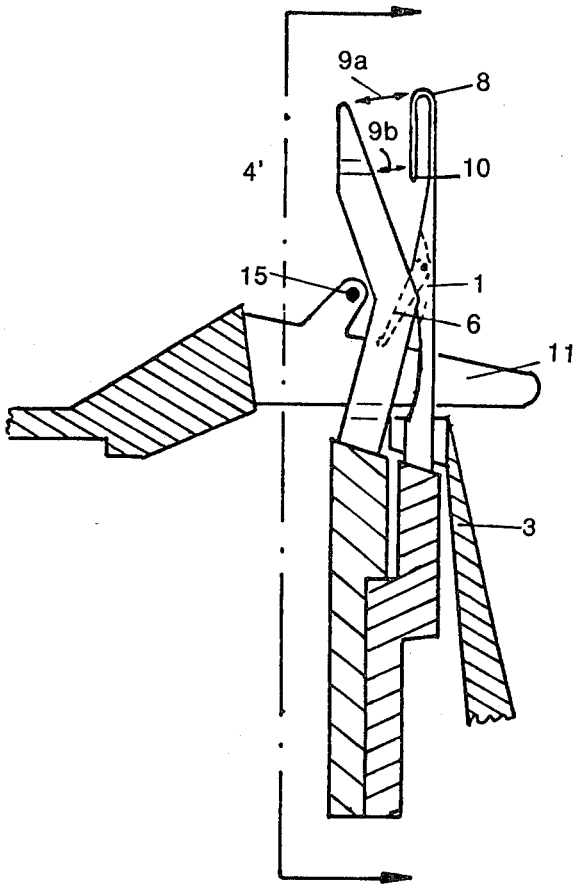
FIG. 3 is an example of operation for keep-off rails crimped in the operating range of the needle latch.
Figure 4:
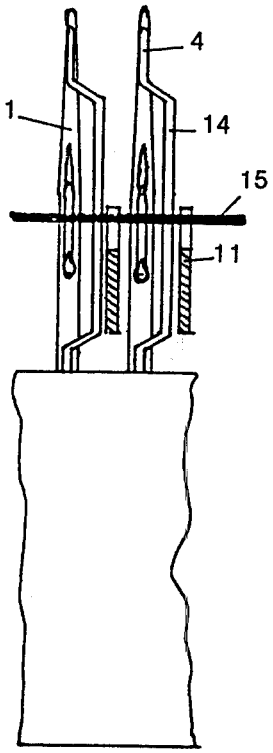
FIG. 4 is a partial side view of FIG. 3.

The example of operation illustrated in FIG. 3 and FIG. 4 is based on the same principle. The difference is, however, that the keep-off rail (4) is not provided with an opening in the operating range of the needle latch, but that it is crimped in the direction of the shifting or shogging motion, as illustrated in the partial side view of FIG. 4. This example of operation will be mainly applied to fabrics requiring greater spacings between the needles, in order to secure an unhindered knitting operation in the needle gutter (spaces between the latch needle). In such a case it will not be required to use individual latch stops, and a wire (5), leading from one end of the machine to the other, and which is supported by the trace comb lamellas, can be used.

It thus will be seen that there is provided a warp knitting machine equipped with latch-type meedles which achieves the various objects of the invention and is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above is presented merely as an example of the invention. Other embodiments, forms and modifications of the invention, coming within the proper scope and spirit of the appended claims, will of course readily suggest themselves to those skilled in the art. Thus, while there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A warp knitting machine equipped with latch-type needles each having a head extending to a predetermined height and each having a needle latch of predetermined length carried by the needle for movement in a predetermined orbit section about a latch pivot at a predetermined location thereon, a trace or stitch comb, a plurality of guide bars for underlapping purposes, and hole needles or guides; characterized by:

(a) keep-off rail means mounted behind at least several of the latch-type needles and for synchronized movement therewith;

(b) said keep-off rail means running from the hole needles or guides to the latch-type needles;

(c) said keep-off rail means extending in the direction of the height of the latch-type needles to an end located at a predetermined position which exceeds in height said predetermined location of said latch pivot;

(d) said keep-off rail means being of a predetermined configuration including at least a portion of said end which is spaced from the latch-type needle a distance less than said predetermined length of said needle latch;

(e) said predetermined configuration of said keep-off rail means being such as to not interfere with the movement of the needle latches.

2. The warp knitting machine of claim 1 having needle leads or latch needle unit means; wherein said keep-off rail means is fastened to the needle leads or latch needle unit means.

3. The warp knitting machine of claim 2 wherein said predetermined position of said end of said keep-off rail means extends to a height proximate the predetermined height of the head of the latch-type needle and is a predetermined distance from the operating range of the needle hook.

4. The warp knitting machine of claim 3 wherein the latch-type needle has a hook-point and wherein said end of said keep-off rail means is spaced from the head of the latch-type needle by a distance greater than the spacing of said keep-off rail means from the hook-point of the latch-type needle.

5. The warp knitting machine of claim 4 wherein said predetermined configuration of said keep-off rail means includes an opening directed towards the latch-type needles and having the shape of an orbit section which is slightly greater than the orbit section described by the needle latch.

6. The warp knitting machine of claim 4 having a predetermined shifting or shogging motion; wherein said predetermined configuration of said keep-off rail means includes a crimped portion off-set in the predetermined direction of the shifting or shogging motion, and to an extent to encompass the operating range of the needle latch.

7. The warp knitting machine of claim 5 wherein latch stops are provided on individual lamella of the trace or stitch comb.

8. The warp knitting machine of claim 7 wherein said latch stops have open ends which are resilient in the direction of the shifting motion.

9. The warp knitting machine of claim 8 wherein said latch stops of said open ends are shaped to enable said latch stopps to spring around an axis which is parallel to the needle axis.

10. The warp knitting machine of claim 9 wherein said latch stops extend from a top edge of the trace or stitch comb lamellas and are attached to same.

11. The warp knitting machine of claim 9 wherein said latch stops extend from a top edge of the trace or stitch comb and are formed as one piece therewith.

12. The warp knitting machine of claim 5 wherein said keep-off rail means extends behind all of the latch-type needles.

* * * * *